US007876292B2

(12) United States Patent
Cho et al.

(10) Patent No.: US 7,876,292 B2
(45) Date of Patent: Jan. 25, 2011

(54) ACTIVE MATRIX OLED DRIVING CIRCUIT USING CURRENT FEEDBACK

(75) Inventors: Gyu-hyeong Cho, Gongju-si (KR); Jin-yong Jeon, Daegu-si (KR); Gun-ho Lee, Bucheon-si (KR); Young-suk Son, Hwaseong-si (KR); Sang Kyung Kim, Daejeon-si (KR)

(73) Assignee: Korea Advanced Institute of Science and Technology, Daejeon-si (KR)

( * ) Notice: Subject to any disclaimer, the term of this patent is extended or adjusted under 35 U.S.C. 154(b) by 1126 days.

(21) Appl. No.: 11/543,588

(22) Filed: Oct. 4, 2006

(65) Prior Publication Data

US 2007/0075939 A1 Apr. 5, 2007

(30) Foreign Application Priority Data

Oct. 5, 2005 (KR) ..... 10-2005-0093561

(51) Int. Cl.
*G09G 3/36* (2006.01)

(52) U.S. Cl. ..... 345/76; 345/77; 345/82; 345/83; 345/204; 315/169.3

(58) Field of Classification Search ..... 345/89, 345/76–77, 82–83, 204; 324/770; 330/1, 330/255, 251, 252, 253; 315/169.3
See application file for complete search history.

(56) References Cited

U.S. PATENT DOCUMENTS 5,266,936 A * 11/1993 Saitoh ..... 345/98
5,721,563 A * 2/1998 Memida ..... 345/98
5,748,160 A 5/1998 Shieh et al.
6,433,488 B1 8/2002 Bu
6,480,178 B1 * 11/2002 Itakura et al. ..... 345/89
6,528,951 B2 * 3/2003 Yamazaki et al. ..... 315/169.3
2004/0085086 A1 * 5/2004 LeChevalier ..... 324/770

* cited by examiner

*Primary Examiner*—Lun-Yi Lao
*Assistant Examiner*—Olga Merkoulova
(74) *Attorney, Agent, or Firm*—Bachman & LaPointe, P.C.

(57) ABSTRACT

An active matrix organic light emitting diode AMOLED driving circuit using current feedback that ensures the uniformity of brightness in pixels of a flat panel display and shortens the time required to input accurate current to respective pixels in the driving circuit.

The prevent invention provides an AMOLED driving circuit using current feedback, comprising: a current digital-to-analog converter outputting a current corresponding to input digital data; a first differential amplifier connected to the current digital-to-analog converter and controlling the input data current and a driving current of a driving transistor of a pixel circuit to be identical to each other; a current mirror mirroring driving current of an organic light emitting diode of the pixel circuit to an input side of the first differential amplifier; and a second differential amplifier coupled to the current mirror and controlling charge and discharge speeds of parasitic capacitance of the pixel circuit.

2 Claims, 10 Drawing Sheets

PRIOR ART

PRIOR ART

ACTIVE MATRIX OLED DRIVING CIRCUIT USING CURRENT FEEDBACK

BACKGROUND OF THE INVENTION

1. Field of the Invention

The present invention relates to a driving circuit for a flat panel display and, more particularly, to an active matrix organic light emitting diode AMOLED driving circuit using current feedback that ensures the uniformity of brightness in pixels of a flat panel display and shortens the time required for inputting accurate current to the respective pixels in the driving circuit.

2. Description of the Related Art

An Organic Light Emitting Diode (OLED) is an element for a flat panel display that has attracted attention recently because it has several merits, that is, it has excellent viewing angle and contrast ratio, it is thin and lightweight, it has low power consumption and can be fabricated at a lower cost.

OLED is an element from which light emission is regulated based on the current applied thereto, and is classified into a passive matrix method and an active matrix method in view of the method of driving the OLED.

In the active matrix method, the voltage for controlling the current applied to the OLED is charged in a capacitor and the charged voltage is kept until a new signal is applied to a subsequent frame.

A conventional pixel circuit and a driving circuit using an OLED having such characteristics will now be described with reference to U.S. Pat. Nos. 5,748,160 and 6,433,488.

FIG. 1 is a basic pixel circuit, depicted in the former, which constitutes a panel having the form of an M×N matrix.

M scan lines SCAN and N data lines Vdata exist in the panel, wherein N pixel circuits in a single row are coupled in parallel to a single scan line SCAN, and M pixel circuits are coupled in parallel to a single data line Vdata.

A driving transistor T1 implemented using a thin film transistor TFT controls the current applied to an OLED. Since the driving transistor T1 and the OLED are connected in series to each other, the current flowing in the driving transistor T1 is identical to that flowing in the OLED.

The current of the driving transistor T1 can be controlled by a voltage data line Vdata suitable to the current-voltage characteristic curve of the driving transistor T1.

Besides, the magnitude of the current of the driving transistor T1 is controlled by the input voltage applied from a switching transistor T2, and the input voltage is charged in a storing capacitor Cs, and then maintained until a subsequent frame starts.

However, in the conventional pixel circuit, the amount of current applied through the same input voltage may vary due to differences between the threshold voltages of the driving transistors, each having one TFT per pixel, thus causing non-uniformity of brightness in the respective pixels.

Accordingly, a current driving method has been proposed to solve such non-uniformity of driving currents due to the differences between the characteristics including the threshold voltages in the respective pixels.

In the voltage driving method depicted in FIG. 1, a voltage for controlling the current to be applied to the OLED is input, whereas, in the current driving method, the current to be applied to the OLED is itself input.

Accordingly, the desired current can be applied to the OLED regardless of differences between the threshold voltages of the respective driving transistors and variation in current mobility.

FIG. 2 shows a driving circuit employing the current driving method using current feedback according to U.S. Pat. No. 6,433,488.

A driving part, except for the pixel circuit in FIG. 2, exists in the respective columns of a panel, to which M pixel circuits are coupled in parallel. The selection of pixel circuits to be driven among the M pixel circuits is made in response to a scan signal SCAN.

A transistor T1 is a driving transistor and transistors T2, T3 and T4 are switching transistors. When the scan signal SCAN is high, transistor T4 is turned off, whereas transistors T2 and T3 are turned on, thus forming a loop comprising transistors T1 and T2, a current comparator, a transistor T3 and an organic light emitting diode.

Here, the current flowing in the driving transistor T1 is a current IOLED applied from a current source IOLED, and a current to be newly input is a current IREF from a current source IREF. Accordingly, the current comparator compares the two currents to apply a control voltage $V_{FB}$ to a gate node of the transistor T1.

The control voltage $V_{FB}$ applied to the gate node of the transistor T1 varies IOLED, which consequently converges to IREF, and corresponding voltage is charged in a capacitor Cs.

However, since a plurality of pixel circuits is connected to one driving circuit of FIG. 2, considerable parasitic capacitance is generated in the data line and in the input of the current comparator.

The parasitic capacitance makes it difficult to secure the stability of the feedback loop and increases the overall response time of the circuit, thus affecting the time required to input current to the pixel circuits.

Particularly, in the case of a larger sized panel, since a much greater number of pixel circuits is coupled to one driving circuit, which results in increased parasitic capacitance, it is very difficult to secure the stability of the feedback loop and the current input speed.

Besides, as the number of pixel circuits per driving circuit is increased, the useful time for updating information in a pixel circuit is reduced. Accordingly, securing the current input speed becomes the most important issue because the current should be input within the reduced time.

More particularly, the current range of the parasitic capacitance of the current driving part (the parasitic capacitance of the anode node of the OLED) is within IOLED, and the current amount is no more than several nA to several μA. Accordingly, if the driving current is not supplemented in this node, it causes considerable difficulty in securing the current input speed.

SUMMARY OF THE INVENTION

Accordingly, the present invention has been made keeping in mind the above problems occurring in the prior art, and an object of the present invention is to provide an Active Matrix Organic Light Emitting Diode (AMOLED) driving circuit using current feedback that ensures brightness uniformity of pixels in a flat panel display by inputting accurate currents to respective pixels by comparing the current flowing in the respective pixels with the current of input data, so that differences between the pixels are minimized.

Another object of the present invention is to provide an AMOLED driving circuit using current feedback, which shortens the time required to input current by increasing the charge and discharge speeds of each node.

To accomplish the objects of the present invention, there is provided an Active Matrix Organic Light Emitting Diode (AMOLED) driving circuit using current feedback, comprising a current digital-to-analog converter outputting a current corresponding to input digital data; a first differential amplifier connected to the current Digital-to-Analog Converter (DAC) and adapted to perform a control operation to cause current of input data to be identical to a driving current of a driving transistor of a pixel circuit; a current mirror mirroring a driving current of a light emitting device of the pixel circuit to an input side of the first differential amplifier; and a second differential amplifier coupled to the current mirror and adapted to control charge and discharge speeds of a parasitic capacitance of the pixel circuit.

Preferably, the first differential amplifier may be implemented using an operational amplifier, an inverting input terminal of which is disposed between the DAC and an output terminal of the current mirror, a non-inverting input terminal of which is connected to a predetermined constant voltage, and an output terminal of which is coupled to a gate terminal of the driving transistor of the pixel circuit.

Preferably, the current mirror may comprise a first transistor, a drain terminal and a gate terminal of which are coupled to each other, and a source terminal of which is coupled to an output terminal of the second differential amplifier, the first transistor receiving the driving current of the light emitting device of the pixel circuit; and a second transistor, a drain terminal of which is coupled to an output terminal of the current DAC, and a gate terminal and a source terminal of which are coupled to the gate terminal and the source terminal of the first transistor, respectively.

Preferably, the second differential amplifier may be implemented using an operational amplifier, an inverting input terminal of which is coupled to the current mirror, a non-inverting input terminal of which is coupled to a predetermined constant voltage, and an output terminal of which is connected to the current mirror.

Further, to accomplish the objects of the present invention, there is provided an Active Matrix Organic Light Emitting Diode (AMOLED) driving circuit using current feedback, comprising a current Digital-to-Analog Converter (DAC) outputting a current corresponding to input digital data; a first differential amplifier connected to the current DAC and adapted to perform a control operation to cause current of input data to be identical to driving current of a driving transistor of a pixel circuit; a current mirror mirroring a driving current of a light emitting device of the pixel circuit to an input side of the first differential amplifier; a second differential amplifier connected to the current mirror and adapted to control charge and discharge speeds of a parasitic capacitance of the pixel circuit; and a loop regulator disposed between the current DAC and an output terminal of the current mirror, thus securing stability of a feedback loop implemented based on the current mirror.

Preferably, the loop regulator may comprise a resistor connected in parallel with each other between the current DAC and an output terminal of the current mirror; and a capacitor connected in series with the resistor.

Further, to accomplish the objects of the present invention, there is provided an Active Matrix Organic Light Emitting Diode (AMOLED) driving circuit using current feedback, comprising a current Digital-to-Analog Converter (DAC) outputting a current corresponding to input digital data; a first differential amplifier connected to the current DAC and adapted to perform a control operation to cause current of input data to be identical to driving current of a driving transistor of a pixel current; a current mirror mirroring driving current of a light emitting device of the pixel circuit to an input side of the first differential amplifier; a second differential amplifier connected to the current mirror and adapted to control charge and discharge speeds of a parasitic capacitance of the pixel circuit; a plurality of compensation capacitors connected in parallel with each other between an inverting input terminal and an output terminal of the first differential amplifier, and required to divide an entire range of data current into a plurality of intervals; a plurality of switches connected in series with the compensation capacitors, respectively; and a switch controller controlling a switching operation of the switches.

Preferably, the switching operation of the switches may be controlled in response to bits of the input digital data.

Further, to accomplish the objects of the present invention, there is provided an Active Matrix Organic Light Emitting Diode (AMOLED) driving circuit using current feedback, comprising a current Digital-to-Analog Converter (DAC) outputting a current corresponding to input digital data; a first differential amplifier connected to the current DAC and adapted to perform a control operation to cause current of input data to be identical to driving current of a driving transistor of a pixel circuit; a current mirror mirroring driving current of a light emitting device of the pixel circuit to an input side of the first differential amplifier; a second differential amplifier connected to the current mirror and adapted to control charge and discharge speeds of a parasitic capacitance of the pixel circuit; an initial state capacitor and a steady state capacitor connected in parallel with each other between an inverting input terminal and an output terminal of the first differential amplifier; a switch connected to the initial state capacitor or the steady state capacitor in response to an input control signal; a buffer amplifier maintaining voltages of the initial state capacitor and the steady state capacitor at a voltage of the inverting input terminal of the first differential amplifier; and a comparator comparing a gate voltage of the driving transistor of the pixel circuit with a predetermined constant voltage, thus outputting the control signal required to control a switching operation of the switch.

In addition, to accomplish the objects of the present invention, there is provided an Active Matrix Organic Light Emitting Diode (AMOLED) driving circuit using current feedback, comprising a current Digital-to-Analog Converter (DAC) outputting a current corresponding to input digital data; a plurality of pixel circuits connected in parallel with each other, and adapted to divide time into a plurality of intervals and to assign the intervals in response to a signal; a first differential amplifier connected to the current DAC and adapted to perform a control operation to cause current of input data to be identical to driving current of a driving transistor of each pixel circuit; a current mirror mirroring driving current of a light emitting device of the pixel circuit to an input side of the first differential amplifier; a second differential amplifier connected to the current mirror and adapted to control charge and discharge speeds of a parasitic capacitance of the pixel circuit; and a loop regulator disposed between the current DAC and an output terminal of the current mirror and adapted to secure stability of a feedback loop implemented based on the current mirror.

Preferably, each of the pixel circuits is implemented so that, as a number of pixel circuits to be driven for a preset time is increased by a factor of k, time assigned to a single pixel circuit is decreased by factor of k.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Hereinafter, a detailed description of the present invention will be made with reference to the attached drawings. The present invention is not restricted to the following embodiments, and many variations are possible within the spirit and scope of the present invention. The embodiments of the present invention are provided in order to more completely explain the present invention to anyone skilled in the art.

Figure 3:
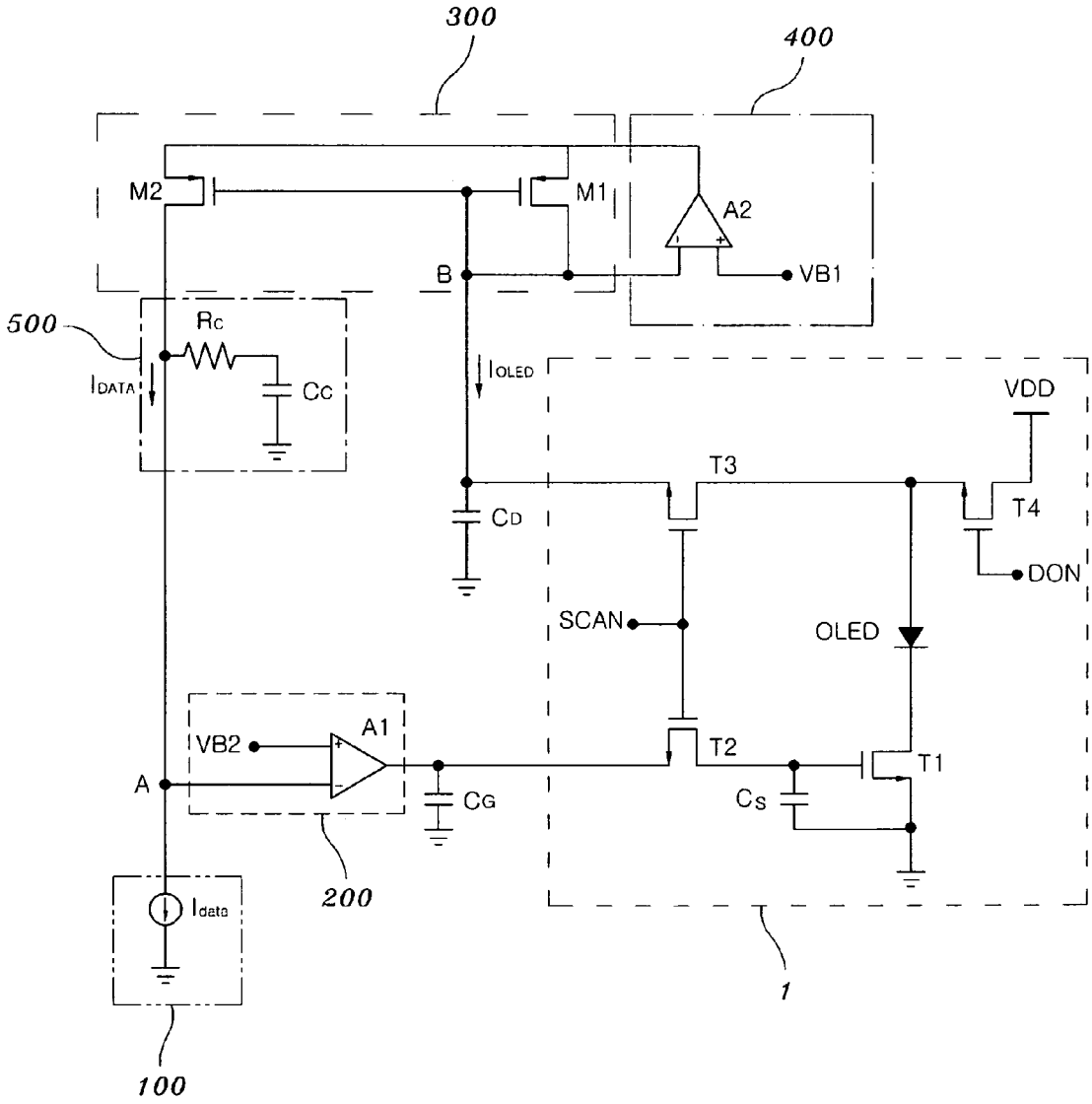
FIG. 3 is a circuit diagram showing an AMOLED driving circuit using current feedback in accordance with the present invention.

FIG. 3 is a circuit diagram showing an AMOLED driving circuit using current feedback in accordance with the present invention.

As shown in the drawing, the AMOLED driving circuit using current feedback comprises a current Digital-to-Analog Converter (DAC) 100 receiving n-bit input digital data to output current having n-bit resolution, and causing the output current thereof to flow toward the ground; a first differential amplifier 200 performing a control operation to cause the current of input data to be identical to the driving current of a driving transistor T1 of a pixel circuit 1, a current mirror 300 mirroring the driving current of a light emitting device (Organic Light Emitting Diode: OLED) to the input side of the first differential amplifier 200; a second differential amplifier 400 controlling the charge and discharge speeds of the parasitic capacitance $C_D$ of the pixel circuit 1; and a loop regulator 500 connected between the output side of the current mirror 300 and the current DAC 100 and adapted to secure the stability of a feedback loop implemented based on the current mirror 300.

The first differential amplifier 200 is implemented using an operational amplifier A1, the inverting input terminal (−) of which is disposed between the output terminal of the current DAC 100 and the output terminal of the current mirror 300, the non-inverting input terminal (+) of which is connected to a predetermined constant voltage VB2, and the output terminal of which is coupled to the gate terminal of the driving transistor T1 of the pixel circuit 1.

The current mirror 300 includes a transistor M1, the drain terminal and gate terminal of which are coupled to each other and the source terminal of which is coupled to the output terminal of the second differential amplifier 400, and a transistor M2, the drain terminal of which is coupled to the output terminal of the current DAC 100, and the gate terminal and source terminal of which are connected to the gate terminal and the source terminal of the transistor M1, respectively.

The second differential amplifier 400 is implemented using an operational amplifier A2, the inverting input terminal (−) of which is coupled to the drain terminal of the transistor M1, the non-inverting input terminal (+) of which is coupled to a predetermined constant voltage VB1, and the output terminal of which is coupled to the source terminals of the transistors M1 and M2.

The loop regulator 500 includes a resistor Rc and a capacitor Cc, and performs a function of compensation in order to secure sufficient loop stability.

Figure 1:
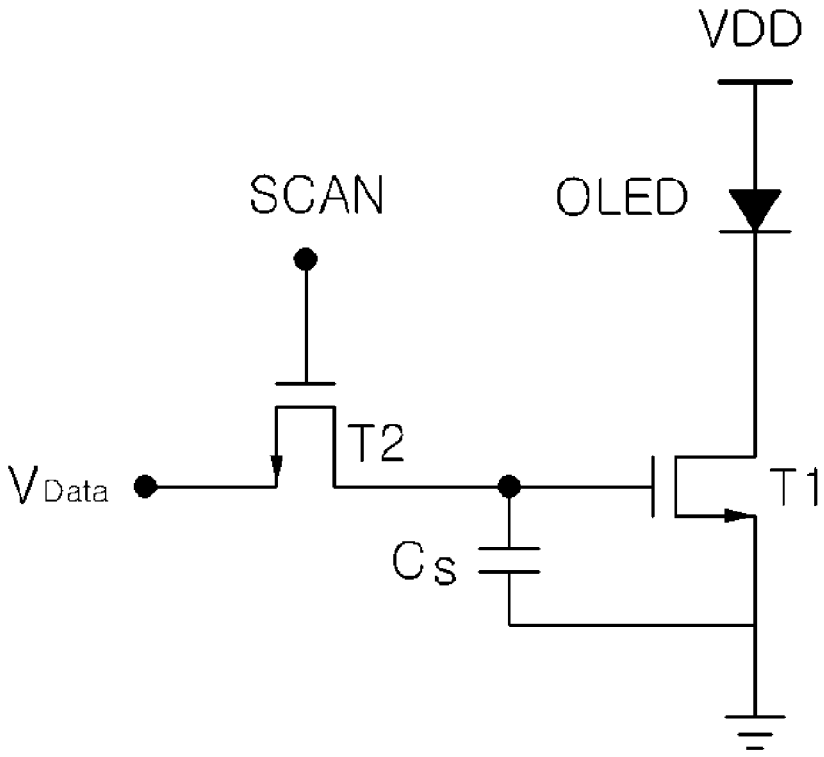
FIG. 1 shows a conventional general pixel circuit.
Figure 2:
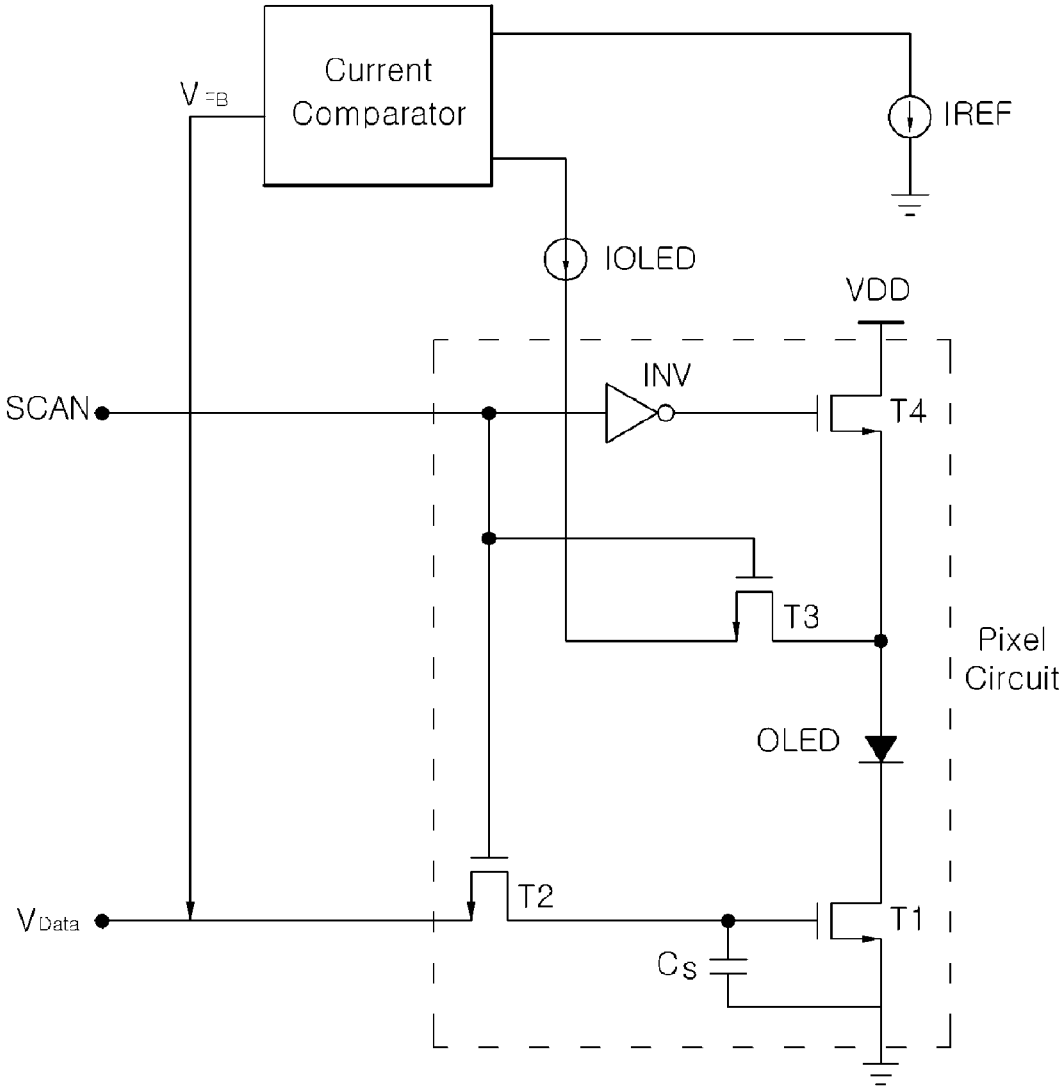
FIG. 2 depicts a driving circuit according to a conventional current driving method.

In accordance with the present invention, constructed as described above, since the pixel circuits for inputting currents as depicted in FIG. 1 are coupled in parallel, the parasitic capacitances are sharply increased in the case of a larger sized panel, and are approximated to parasitic capacitances $C_G$ and $C_D$.

Transistors T2, T3 and T4 in the pixel circuit 1 are switching transistors, wherein the transistors T2 and T3 are controlled in response to a scan signal SCAN and the transistor T4 is controlled in response to a scan bar signal DON, which is an inverted signal of the scan signal SCAN.

While the scan signal SCAN is high, the scan bar signal DON becomes low to form a loop composed of transistor T1-transistor T3-transistor M1-transistor M2-operational amplifier A1, thus inputting the current through current feedback.

After the scan signal SCAN becomes low, the scan bar signal DON becomes high and the OLED keeps the light emitted based on the magnitude of input current until a subsequent frame starts.

Moreover, $I_{DATA}$ denotes the current input to the pixel circuit 1, and $I_{OLED}$ denotes the current presently flowing in the OLED.

If the magnitudes of $I_{DATA}$ and $I_{OLED}$ are the same, the voltage at a node A is identical to the constant voltage VB2 of the non-inverting input terminal (+) of the operational amplifier A1.

If the magnitudes of $I_{DATA}$ and $I_{OLED}$ are different from each other, the voltage at node A is varied to thus change the output of the operational amplifier A1. The changed output of the operational amplifier A1 is input to control the driving transistor T1. Based on the output of the operational amplifier A1, the voltage VGS between the gate and source terminals of the driving transistor T1 is varied to control $I_{OLED}$, thus converging to $I_{DATA}$.

For example, if $I_{DATA}$ is larger than $I_{OLED}$, the voltage at node A is decreased to a ground voltage, and the output voltage of the operational amplifier A1 increases. Since the output of the operational amplifier A1 becomes the gate voltage of the driving transistor T1, VGS of the driving transistor T1 increases. As a result, the magnitude of $I_{OLED}$ increases.

If $I_{DATA}$ is smaller than $I_{OLED}$, the voltage at node A is increased toward the earth and the output voltage of the operational amplifier A1 decreases. Accordingly, VGS of the driving transistor T1 decreases and the magnitude of $I_{OLED}$ decreases.

Accordingly, when applying a new $I_{DATA}$, $I_{OLED}$ increases and decreases repeatedly to eventually converge to $I_{DATA}$ as time goes by.

Like this, when inputting current without using negative feedback, the parasitic capacitance $C_G$ is charged and discharged based on the magnitude of input current, which results in a slow progress, however, when using the negative feedback, it remarkably improves the charge and discharge speeds of the parasitic capacitance $C_G$ of the pixel circuit 1 by virtue of the current driving capability of the operational amplifier A1.

Moreover, the operational amplifier A2 functions to improve the charge and discharge speeds of the parasitic capacitance $C_D$ of the pixel circuit 1.

That is, the output of the operational amplifier A1 varies the drain current of the driving transistor T1, so that a difference is created between the drain current of the driving transistor T1 and the drain current of the transistor M1 of the current mirror 300, thus changing the voltage at node B.

To regulate the current $I_{OLED}$ so that the magnitude thereof is rapidly controlled in response to the output of the operational amplifier A1, the voltage at node B should be rapidly restored. For this, a negative feedback circuit, composed of the transistor M1 of the current mirror 300 and the operational amplifier A2, is used.

For example, if the drain current of the driving transistor T1 is increased, the voltage at node B decreases to the ground voltage and the output voltage of the operational amplifier A2 increases.

Accordingly, VGS of the transistor M1 increases to output higher drain current, thus charging the parasitic capacitance $C_D$ more rapidly.

That is, the current of the transistor M1 is highly responsive to variations in current of the driving transistor T1.

Meanwhile, the loop's stability is a key point in a structure having positive feedback. Particularly, in the case 10 of a larger sized panel, it is difficult to secure the stability due to the larger parasitic capacitances and resistances.

To overcome the above drawback, the resistor Rc and the capacitor Cc of the loop regulator 500 execute a function of compensation in order to secure sufficient loop stability. That is, dominant pole compensation is made via the capacitor Cc and zero compensation is carried out via a combination of the resistor Rc and the capacitor Cc, thus providing sufficient bandwidth. Consequently, it is possible to secure stability by achieving a good response of the circuit and a sufficient phase margin.

Figure 4:
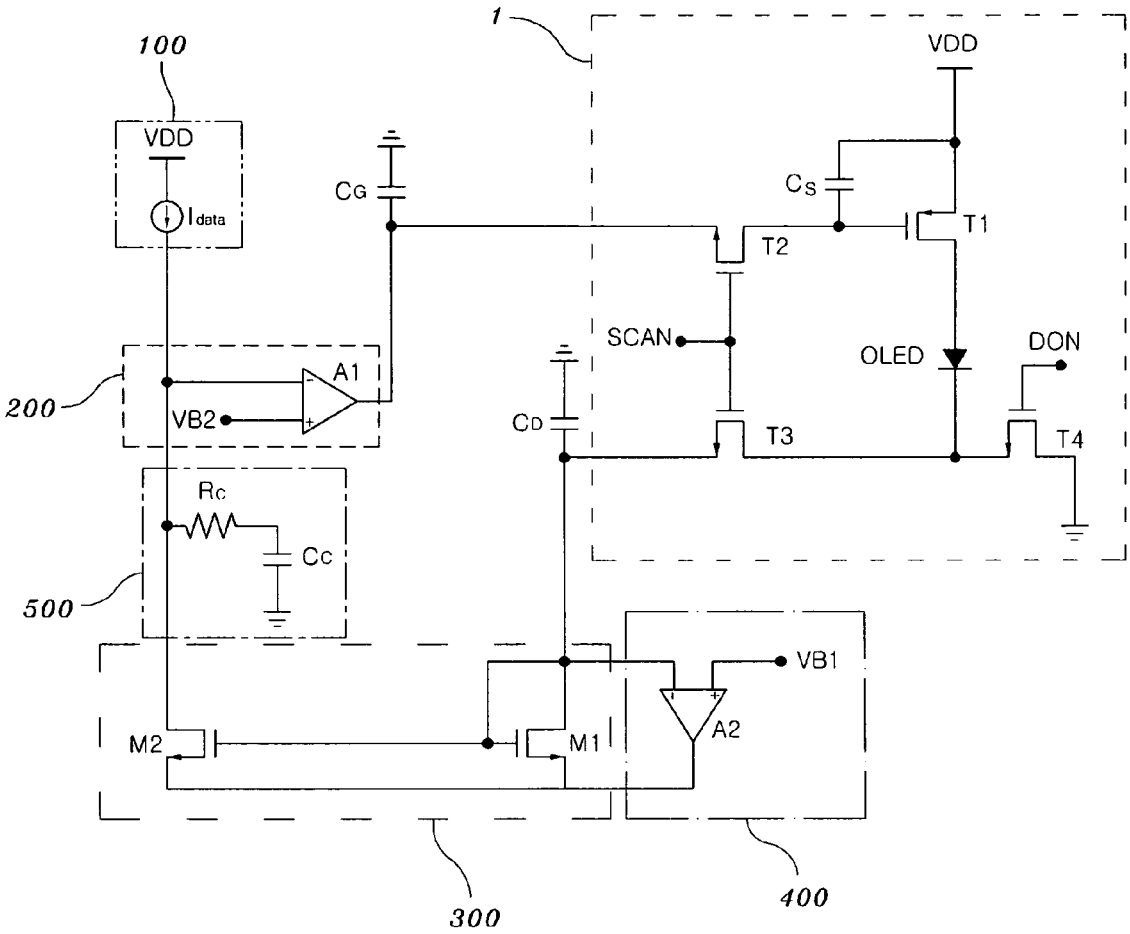
FIG. 4 is a circuit diagram depicting a complementary circuit of the circuit of FIG. 3.

FIG. 4 is a diagram depicting a complementary circuit of the circuit of FIG. 3. Since the complementary circuit of FIG. 4 operates according to the same principle and in the same manner as the structure of FIG. 3, a detailed description thereof will be omitted here.

Figure 5:
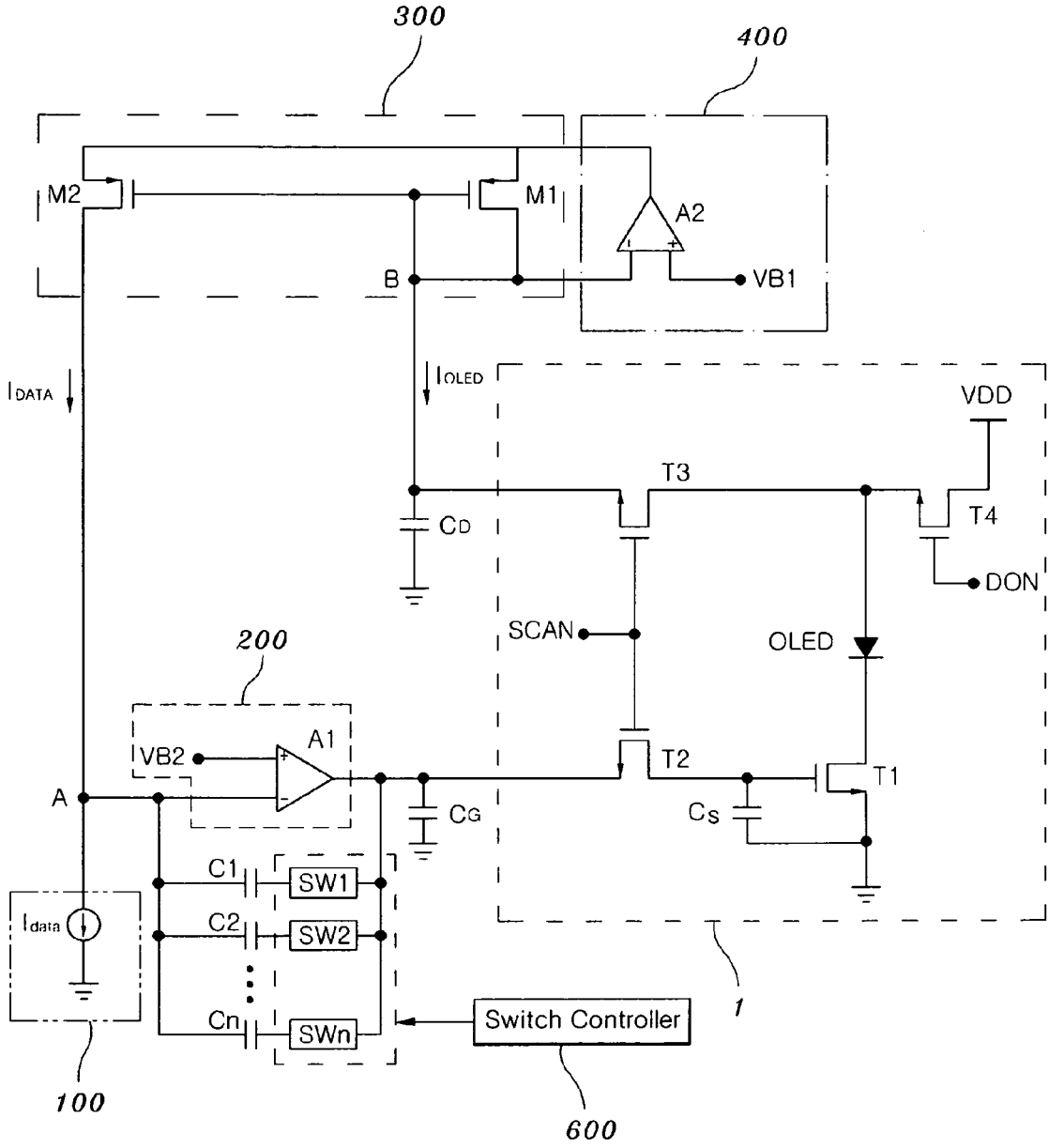
FIGS. 5 and 6 are circuit diagrams showing other embodiments of an AMOLED driving circuit using current feedback in accordance with the present invention.

FIG. 5 is a circuit diagram showing another embodiment of an AMOLED driving circuit using current feedback according to the present invention. Since the loop characteristics vary with the magnitude of data current $I_{DATA}$, uniform compensation for all data current cannot be expected through compensation using only the resistor Rc and the capacitor Cc of the loop regulator 500 proposed in FIG. 3. That is, compensation using the circuit of FIG. 3 may cause a problem in which the response time increases or stability decreases depending on the range of data current.

Therefore, there is a need to reduce differences between loop characteristics by varying the levels of compensation according to the magnitude of data current. FIG. 5 is a circuit diagram showing this requirement, and illustrates a structure in which the loop regulator 500 is removed from the circuit diagram of FIG. 3, and Miller compensation is applied using n capacitors C1 to Cn.

As shown in the drawing, the AMOLED driving circuit comprises a Digital-Analog Converter (DAC) 100 receiving n-bit input digital data to output current having n-bit resolution, and causing the output current thereof to flow toward the ground, a first differential amplifier 200 performing a control operation to cause current of input data to be identical to the driving current of a driving transistor T1 of a pixel circuit 1, a current mirror 300 mirroring the driving current of a light emitting device (OLED) to the input side of the first differential amplifier 200, a second differential amplifier 400 controlling the charge and discharge speeds of the parasitic capacitance $C_D$ of the pixel circuit 1, n compensation capacitors C1 to Cn connected in parallel with each other between the inverting input terminal (−) and the output terminal of the first differential amplifier 200 and adapted to divide the entire range of data current into n intervals, n switches SW1 to SWn connected in series with the compensation capacitors C1 to Cn, respectively, and a switch controller 600 controlling the switching operation of the switches SW1 to SWn.

In the embodiment of the driving circuit of FIG. 5 having the above construction, the entire range of data current is divided into n intervals, and the n compensation capacitors C1 to Cn correspond to the intervals, respectively, and thus any one of the compensation capacitors is selected using the switches SW1 to SWn, depending on the magnitude of the data current. The switches SW1 to SWn, connected to the compensation capacitors C1 to Cn, are controlled by the switch controller 600.

That is, since the embodiment of FIG. 5 is implemented to divide the range of data current into n intervals, variation in the magnitude of current decreases during a single interval in proportion to the number of intervals, and differences between loop characteristics also decrease. In FIG. 5, a description of components identical to those of the embodiment of FIG. 3 is omitted.

Figure 6:
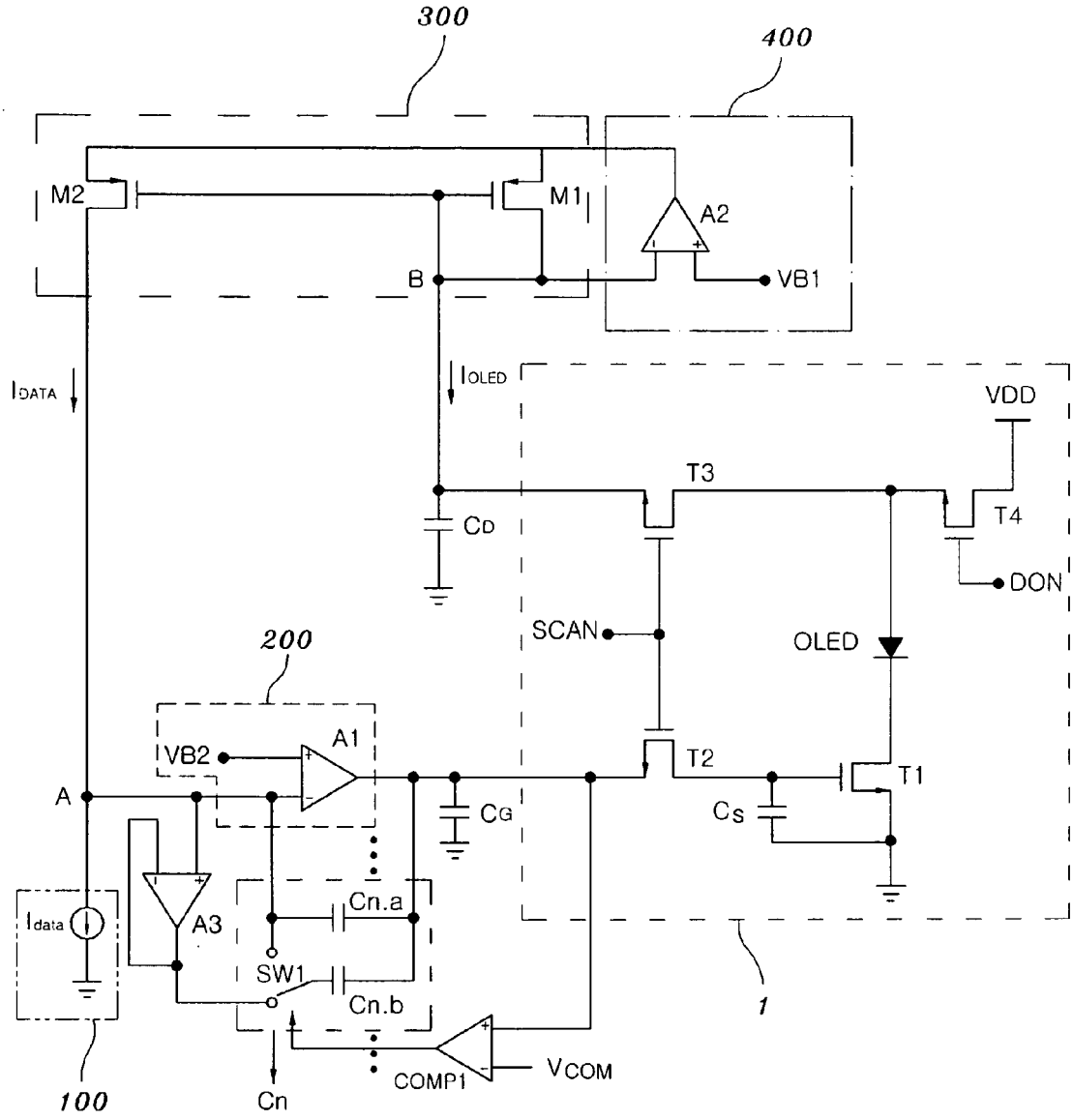

FIG. 6 is a circuit diagram showing another embodiment of an AMOLED driving circuit using current feedback according to the present invention, and illustrates an embodiment for reducing the delay time occurring due to the charging/discharging of the compensation capacitors of FIG. 5.

In FIG. 5, if data current varies, the voltage at node A also varies, thus output current varies while the entire loop is operated. For high speed operation, there is a need to vary the voltage at the node A quickly. Factors influencing the speed of voltage variation include the capacitances of the compensation capacitors C1 to Cn, connected to the node A, and the magnitude of the current $I_{DATA}$. As $I_{DATA}$ decreases, the time delay increases, so that such a problem must be solved, especially in a low current region, and a structure for solving the problem is shown in FIG. 6.

As shown in the drawing, the AMOLED driving circuit comprises a current Digital-Analog Converter (DAC) 100 receiving n-bit input digital data to output current having n-bit resolution, and causing the output current thereof to flow toward the ground, a first differential amplifier 200 performing a control operation to cause current of input data to be identical to the driving current of a driving transistor T1 of a pixel circuit 1, a current mirror 300 mirroring the driving current of a light emitting device (OLED) to the input side of the first differential amplifier 200, a second differential amplifier 400 controlling the charge and discharge speeds of the parasitic capacitance $C_D$ of the pixel circuit 1, an initial state capacitor Cn.a and a steady state capacitor Cn.b connected in parallel with each other between the inverting input terminal (−) and the output terminal of the first differential amplifier 200, a switch SW1 connected to the initial state capacitor Cn.a or the steady state capacitor Cn.b in response to an input control signal, a buffer amplifier A3 maintaining the voltage of the initial state capacitor Cn.a and the steady state capacitor Cn.b at the voltage of the inverting input terminal (−) of the first differential amplifier 200, and a comparator COMP1 comparing the gate voltage of the driving transistor T1 of the pixel circuit 1 with a predetermined constant voltage VCOM, thus outputting the control signal required to control the switching operation of the switch SW1.

The buffer amplifier A3 has an output terminal, which is connected to the switch SW1 and is also connected to the inverting input terminal (−) of the buffer amplifier A3, and has a non-inverting input terminal (+), which is connected to the inverting input terminal (−) of the first differential amplifier 200.

The comparator COMP1 is implemented so that the non-inverting input terminal (+) thereof is connected to the output terminal of the first differential amplifier 200, and a predetermined constant voltage VCOM is input to the inverting input terminal (−) thereof.

In the embodiment of FIG. 6, having the above construction, Cn denotes any one of the n compensation capacitors C1 to Cn shown in FIG. 5.

In this case, Cn=Cn.a+Cn.b is satisfied, and the initial state capacitor Cn.a has a capacitance sufficiently lower than that of the steady state capacitor Cn.b. As the capacitance of the node A increases, the time required to charge or discharge the capacitor increases, so that only the initial state capacitor Cn.a is connected to the node A at the initial stage, thus increasing the speed at which the voltage at the node A varies.

Since stability cannot be secured using only the initial state capacitor Cn.a, the steady state capacitor Cn.b is connected to the node A at the time point when the state of the node A approaches a steady state. The steady state is monitored using the comparator COMP1.

That is, at the time point at which the gate voltage of the driving transistor T1 intersects the predetermined constant voltage VCOM, which is applied to the inverting input terminal (−) of the comparator COMP1, the steady state capacitor Cn.b is connected to the initial state capacitor Cn.a through the switch SW1.

In other words, the steady state capacitor Cn.b is connected to the output terminal of the buffer amplifier A3 at the initial stage, and is then connected to the initial state capacitor Cn.a at the time point at which the gate voltage of the driving transistor T1 intersects the predetermined constant voltage VCOM.

Meanwhile, at the time of the connection, if the voltage of the initial state capacitor Cn.a is different from that of the steady state capacitor Cn.b, a time delay occurs again in a procedure for making the two voltages identical to each other. Accordingly, the voltage of the steady state capacitor Cn.b is maintained at the voltage at the node A by the buffer amplifier A3 until the steady state capacitor Cn.b is connected to the initial state capacitor Cn.a.

In FIG. 6, a description of components identical to those of the embodiment of FIG. 3 is omitted.

As described in detail above, since the non-uniformity of brightness between the respective pixels in a flat panel display results from differences between the characteristics of thin film transistors (TFTs) constituting the respective pixels, the present invention has been invented to provide a feedback circuit capable of inputting accurate current to the respective pixels in the flat panel display by comparing the current flowing in the pixel via a current mirror with input current, using a current feedback method, to minimize differences between respective pixels, thus ensuring the uniformity of brightness in the pixels of the flat panel display.

Moreover, in order to solve the problem in which data input speed is decreased due to the parasitic capacitances and resistances caused mainly in a large panel, and which has not been solved in a conventional driving circuit, the present invention is provided to shorten the charge and discharge speeds of nodes loaded with the data currents by charging and discharging the voltages of the nodes of the capacitances and resistances using an operational amplifier, thus reducing the time required to input accurate currents to the respective pixels in the driving circuit.

Figure 7:
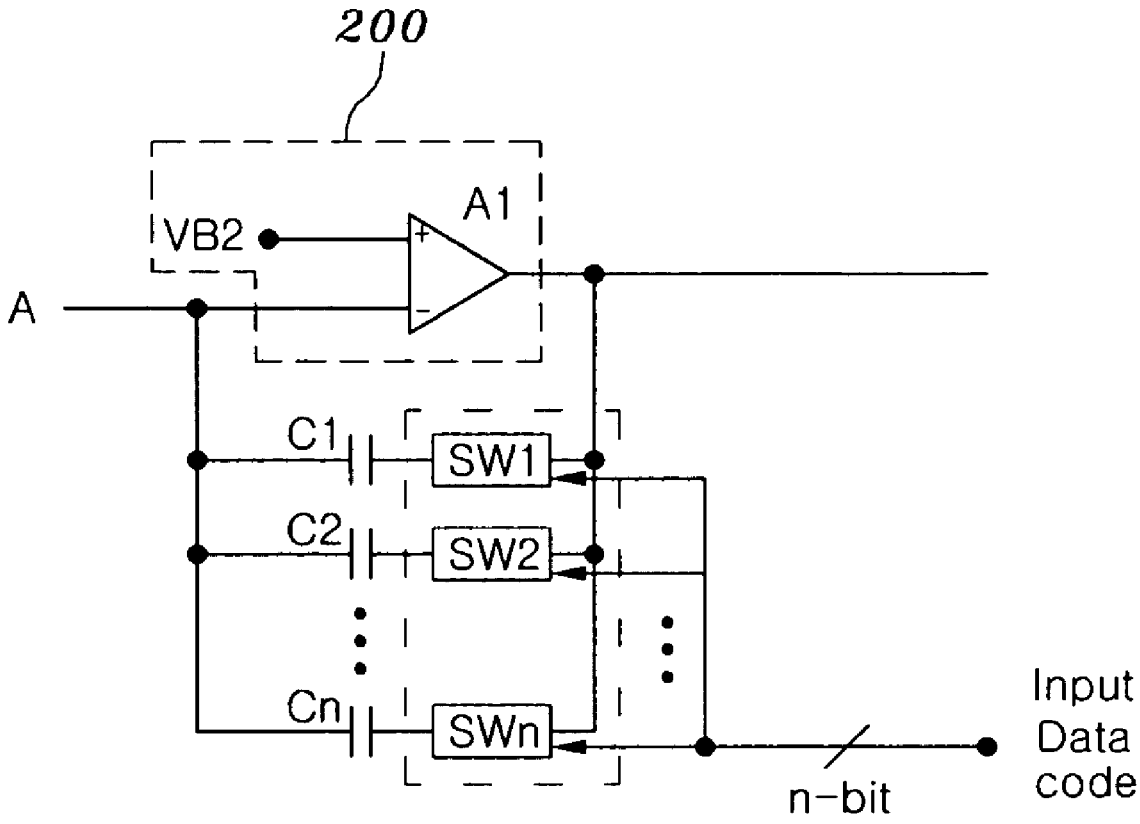
FIG. 7 is a circuit diagram showing an embodiment of a scheme for controlling switches in a compensation part using the differential amplifier of FIG. 5.

FIG. 7 is a circuit diagram showing an embodiment of a scheme for controlling switches in a compensation part using the differential amplifier of FIG. 5.

As shown in FIG. 7, the scheme for controlling switches in the compensation part is implemented to use a number of compensation capacitors C1 to Cn corresponding to the number of bits of input digital data, and to use the bits of the input digital data as on/off signals for the switches SW1 to SWn corresponding to the capacitors C1 to Cn.

If the switches SW1 to SWn are controlled in this way, the compensation capacitors C1 to Cn are variously combined with each other.

For example, if input data bits are 101101, the total capacitance value of the capacitors is given by C1+C3+C4+C6.

Since $2^n$ combinations can be obtained using n compensation capacitors by applying the above method, the bandwidth can be more finely adjusted.

In this case, the number of capacitors does not necessarily need to be equal to the number of data bits, and may be less than the number of data bits. However, in this case, a separate logic circuit is preferably required to allow the capacitors to operate in all data regions.

Figure 8:
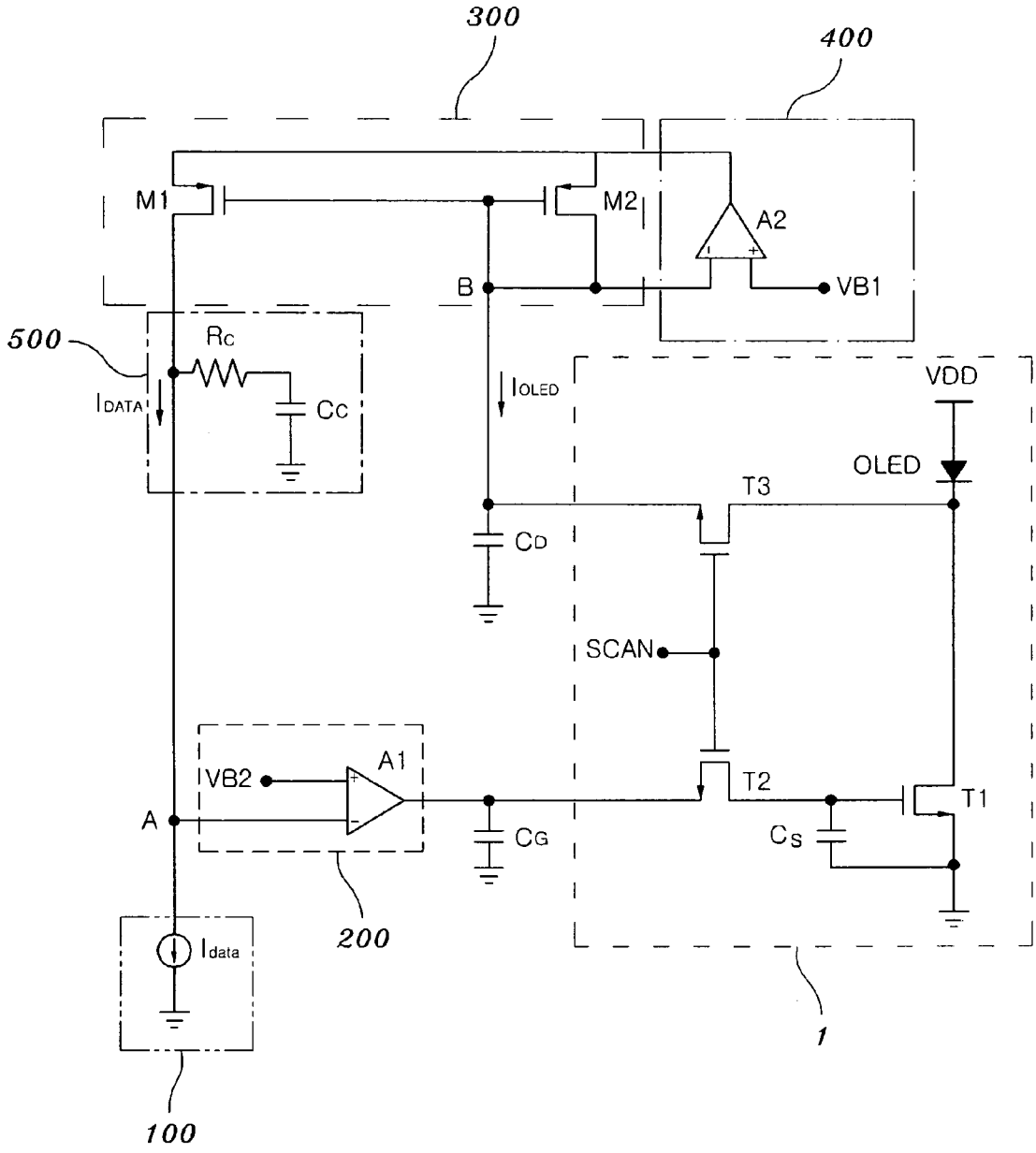
FIG. 8 is a circuit diagram showing an example in which the AMOLED driving circuit using current feedback according to the present invention is applied to a pixel circuit.

FIG. 8 is a circuit diagram of an example in which the AMOLED driving circuit using current feedback according to the present invention is applied to a pixel circuit.

As shown in the drawing, FIG. 8 illustrates an example in which the driving circuit of the present invention is applied to a conventional pixel circuit. The basic operating principles thereof are equal to those in FIG. 3, but the voltage of the cathode of a diode must be maintained using a predetermined constant voltage VB1 in order to turn off the light emitting device (OLED) during the operation of inputting current.

Figure 9:
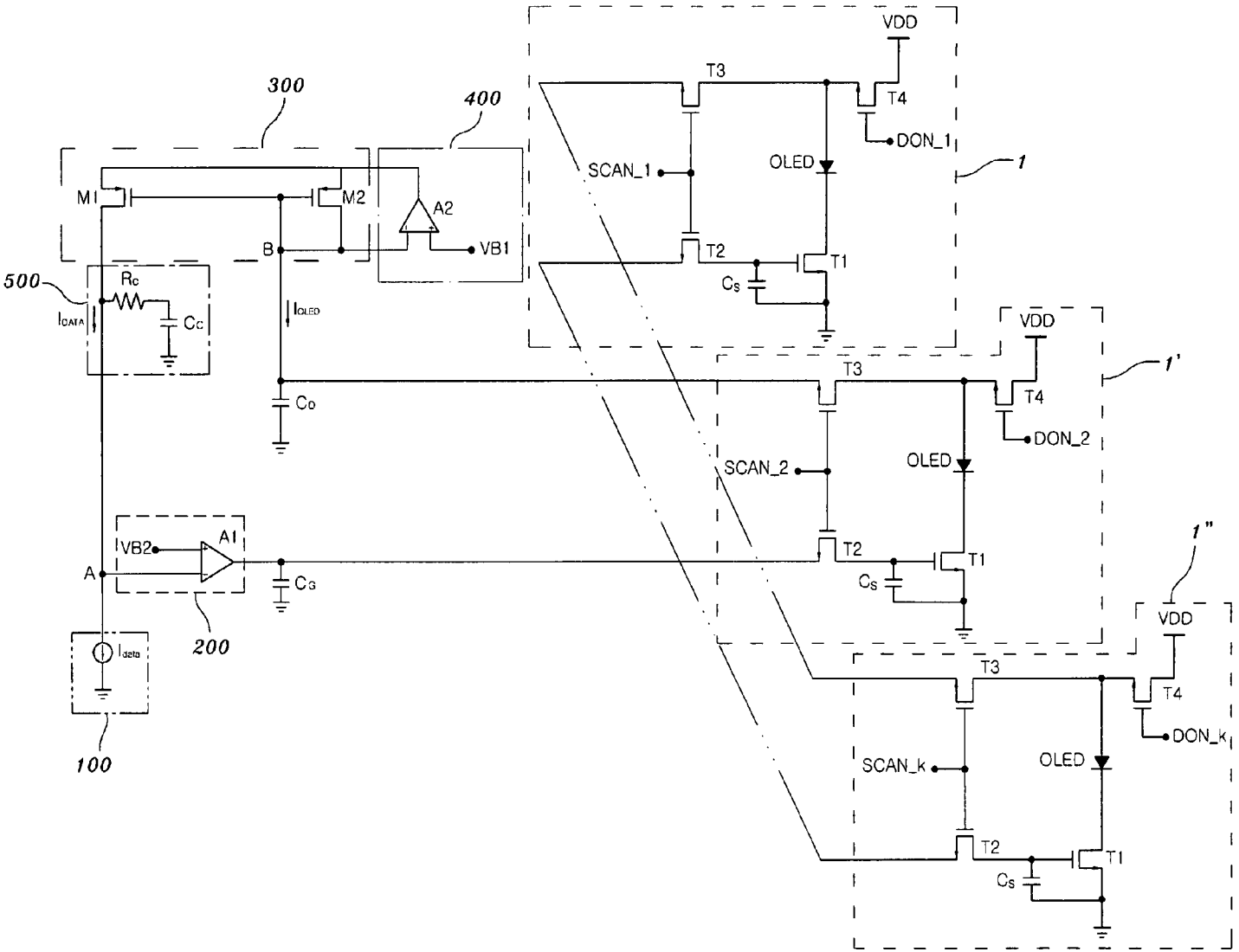
FIG. 9 is a circuit diagram showing an example of a method of driving a plurality of pixel circuits using any one of AMOLED driving circuits using current feedback according to the present invention.
Figure 10:
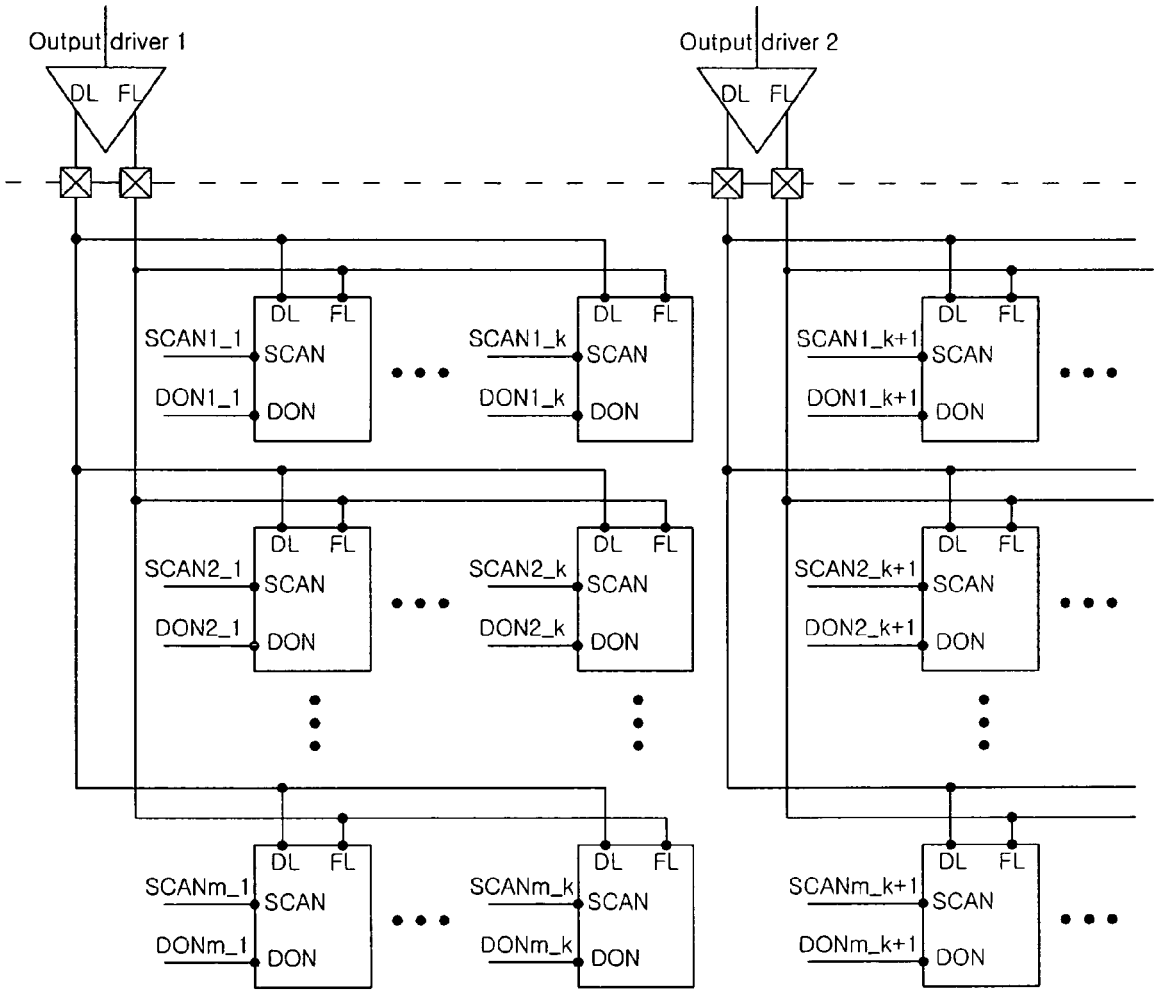
FIG. 10 is a diagram showing the driving method of FIG. 9 implemented in the form of a matrix in a panel.

FIG. 9 is a circuit diagram showing an example of a method of driving a plurality of pixel circuits using any one of various AMOLED driving circuits using current feedback according to the present invention, and FIG. 10 is a diagram showing the driving method of FIG. 9 implemented in the form of a matrix in a panel.

As shown in the drawings, k pixel circuits existing in the same row are driven by a single driving circuit. A single driving circuit to be operated is determined in response to signals SCAN 1 to SCAN k.

Since the number of pixel circuits 1, 1', 1" to be driven for a preset time is increased to k, the time assigned to a single pixel circuit is decreased by a factor of k, and thus the driving circuit must secure speed that is increased by a factor of k, in order to use such a method.

Accordingly, the present invention provides the following advantages.

First, the present invention overcomes the non-uniformity of brightness in respective pixels resulting from differences between the characteristics of the driving transistors constituting the respective OLED pixel circuits through a method of applying current directly to respective pixel circuits. Accordingly, it is possible to apply a uniform amount of current to respective pixels, even when the characteristics of the driving transistors constituting the respective pixels are different from one another, or even when the characteristics vary as time goes by, thus maintaining the uniformity of brightness of the pixels.

Second, in the case of a conventional structure that drives the circuit by applying current, the feedback loop stability and the current input speed are subject to limitations due to the parasitic capacitances existing in OLED anodes, and it is more difficult to apply the conventional structure to a larger sized panel. However, the present invention increases the current input speed by charging and discharging the parasitic capacitances rapidly and efficiently and, at the same time, can be applied to a large sized panel, in which the magnitude of parasitic capacitance is geometrically increased, using the current driving method.

As described in detail above, the present invention has been disclosed herein with reference to preferred embodiments, however, it will be understood by those skilled in the art that various changes in form and details may be made without departing from the spirit and scope of the present invention as set forth in the following claims.

What is claimed is:

1. An Active Matrix Organic Light Emitting Diode (AMOLED) driving circuit using current feedback, comprising:

a current Digital-to-Analog Converter (DAC) outputting a current corresponding to input digital data;

a first differential amplifier connected to the current Digital-to-Analog Converter (DAC) and adapted to perform a control operation to cause current of input data to be identical to a driving current of a driving transistor of a pixel circuit, wherein the first differential amplifier is implemented using an operational amplifier, an inverting input terminal of which is disposed between the DAC and an output terminal of the current mirror, a non-inverting input terminal of which is connected to a predetermined constant voltage, and an output terminal of which is coupled to a gate terminal of the driving transistor of the pixel circuit;

a current mirror mirroring a driving current of a light emitting device of the pixel circuit to an input side of the first differential amplifier, wherein the current mirror comprises a first transistor, a drain terminal and a gate terminal of which are coupled to each other, and a source terminal of which is coupled to an output terminal of the second differential amplifier, the first transistor receiving the driving current of the light emitting device of the pixel circuit and a second transistor, a drain terminal of which is coupled to an output terminal of the current DAC, and a gate terminal and a source terminal of which are coupled to the gate terminal and the source terminal of the first transistor, respectively; and a second differential amplifier connected to the current mirror and adapted to control charge and discharge speeds of a parasitic capacitance of the pixel circuit, wherein the second differential amplifier is implemented using an operational amplifier, an inverting input terminal of which is coupled to the current mirror, a non-inverting input terminal of which is coupled to a predetermined constant voltage, and an output terminal of which is connected to the current mirror;

a plurality of compensation capacitors connected in parallel with each other between an inverting input terminal and an output terminal of the first differential amplifier, and required to divide an entire range of data current into a plurality of intervals;

a plurality of switches connected in series with the compensation capacitors, respectively; and a switch controller controlling a switching operation of the switches.

2. The AMOLED driving circuit using current feedback according to claim 1, wherein the switching operation of the switches is controlled in response to bits of the input digital data.

* * * * *